US006094768A

United States Patent [19]

Hugon et al.

[11] Patent Number: 6,094,768

[45] Date of Patent: Aug. 1, 2000

[54] TRANSVERSAL TOOTHBRUSH

[76] Inventors: Roland Hugon, La Roche, F-43160 Sembadel; Josette Grivon, 2, rue du Parc, F-43270 Allègre, both of France

[21] Appl. No.: 09/180,027

[22] PCT Filed: May 21, 1997

[86] PCT No.: PCT/FR97/00893

§ 371 Date: Oct. 28, 1998

§ 102(e) Date: Oct. 28, 1998

[87] PCT Pub. No.: WO97/43923

PCT Pub. Date: Nov. 27, 1997

[30] Foreign Application Priority Data

| | | | |
|---|---|---|---|
| May 21, 1996 | [FR] | France | 96 06529 |
| Jul. 26, 1996 | [FR] | France | 96 09684 |
| Oct. 1, 1996 | [FR] | France | 96 12160 |

[51] Int. Cl.[7] ..... A46B 5/00; A46B 7/02; A46B 9/04

[52] U.S. Cl. ..... 15/167.1; 15/143.1; 15/144.1; 15/172; D4/104; D4/110; D4/112

[58] Field of Search ..... 15/143.1, 144.1, 15/167.1, 172; D4/104, 108–110, 112

[56] References Cited

U.S. PATENT DOCUMENTS

| | | | |
|---|---|---|---|
| 1,647,453 | 11/1927 | Krantz | 15/167.1 |
| 1,675,139 | 6/1928 | Saxe | 15/172 |
| 2,047,613 | 7/1936 | Brown | 15/172 X |
| 2,084,873 | 6/1937 | Strause | 15/167.1 |
| 3,100,309 | 8/1963 | Gambino | 15/167.1 |
| 3,474,481 | 10/1969 | Soleymani et al. | 15/143.1 X |
| 4,399,582 | 8/1983 | Ernest et al. | 15/167.1 X |
| 4,403,623 | 9/1983 | Mark | 15/172 X |
| 4,457,039 | 7/1984 | Massari | 15/143.1 X |
| 4,575,894 | 3/1986 | Stevens et al. | 15/172 |
| 5,032,082 | 7/1991 | Herrera | 433/141 |
| 5,054,154 | 10/1991 | Schiffer et al. | 15/172 X |
| 5,315,730 | 5/1994 | Kim et al. | 15/167.1 |
| 5,564,150 | 10/1996 | Ciccotelli | 15/167.1 |
| 5,570,487 | 11/1996 | Schneider | 15/167.1 |

FOREIGN PATENT DOCUMENTS

| | | | |
|---|---|---|---|
| 613636 | 9/1994 | European Pat. Off. . | |
| 2522944 | 9/1983 | France | 15/167.1 |
| 2583963 | 1/1987 | France . | |
| 2593364 | 7/1987 | France | 15/167.1 |
| 2311043 | 9/1974 | Germany . | |
| 2837962 | 3/1980 | Germany | 15/167.1 |
| 3228946 | 2/1984 | Germany | 15/167.1 |
| 256734 | 1/1928 | Italy | 15/167.1 |
| 7-313251 | 12/1995 | Japan . | |
| 169650 | 8/1934 | Switzerland | 15/167.1 |
| 484331 | 5/1938 | United Kingdom | 15/167.1 |
| 1164597 | 9/1969 | United Kingdom | 15/167.1 |
| 2035073 | 6/1980 | United Kingdom | 15/167.1 |
| 2101476 | 1/1983 | United Kingdom . | |
| 17732 | 9/1985 | United Kingdom | 15/167.1 |
| 95/01113 | 1/1995 | WIPO . | |

*Primary Examiner*—Mark Spisich
*Attorney, Agent, or Firm*—Polster, Lieder, Woodruff & Lucchesi

[57] ABSTRACT

The invention features a so-called transversal toothbrush to ensure greater brushing efficiency between the teeth and at the neck level of the teeth. It is characterized in that the direction of the handle (2) is preferably perpendicular relative to the longitudinal direction of the brush body (1). The handle is either connected fixedly with the brush body but with a deformation region (6) for transversal or longitudinal use, or it is mounted movably on the brush body. A mechanism for blocking it in position are provided on the brush body by a truncated cone (10) topped by a shaft (13) and opposite, on the handle, by an apertured hood (16) comprising two lugs (17) and part of a cylinder (18).

39 Claims, 4 Drawing Sheets

TRANSVERSAL TOOTHBRUSH

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention features a transversal toothbrush with a manual grip handle or attached to a power machine to provide, respectively, manual or mechanical brushing of the teeth with improved effectiveness.

Known toothbrushes are composed of a body, a front face, and a handle. The brush body is approximately rectangular and has rows of 7 to 12 tufts of bristles aligned in the direction of the length of the brush body. This body is extended along the length on one small side by a handle; such brushes are then called longitudinal brushes. There are also toothbrushes having a circular brush body with a diameter on the order of 1 cm for special applications.

With such brushes, the brushing of the teeth is done primarily by large amplitude longitudinal push-and-pull movements from front to back according to the longitudinal direction of the brush parallel to the rows of teeth, perpendicular to the direction of the teeth, and therefore called longitudinal brushing.

The known longitudinal toothbrushes were obviously required because until now it was thought that the brushing should be done parallel to the rows of teeth with large amplitude back and forth movements, from the incisors to the molars, using the muscles of the arm which make the forearm turn at the elbow or by pivoting the whole arm at the shoulder through the action of the rotator muscles.

The toothbrush according to the invention runs counter to such evidence and habits with respect to the brushing of teeth. It is composed of an essentially rectangular brush body with a handle appreciably angled, preferably perpendicular to the longitudinal direction of the brush body. Although at first sight this new configuration would appear not to work well because of not reaching the back teeth, it allows effective brushing because it promotes a transversal brushing consisting of an up and down transversal movement perpendicular to the rows of teeth and parallel to the teeth and to their implantation.

This "transversal" brushing cleans the prominent parts, and also the interstices and recessed parts of the teeth where material tends to collect and become stuck. It also allows a better massaging action on the gingiva, with greater efficiency in eliminating tartar at the collum dentis.

Longitudinal brushing with known longitudinal brushes permits good cleaning of the prominent parts of the teeth, but is not very effective on the interstices and recessed parts of the teeth. With such brushes transversal brushing is also quite possible, but with little vigor because it consists of a somewhat unnatural oscillating movement obtained by the rotating action of the wrist, the muscles of which are not very precise, strong or efficacious for exercise of this type.

Advantageously, the brush according to the invention allows brushing to be done when the handle is held fully in the hand, not using an oscillating movement but rather by pushes and pulls produced by turning the arm on itself with the bent forearm remaining rigid, or by pivoting the whole arm around the shoulder using the rotator muscles. In this case the inside of the hand is facing the chest, the articulation of the wrist, the muscles of the forearm and arm exercise significant pressure on the brush and the transversal brushing is very vigorous in the reciprocating vertical movements. This hold on the handle is the only one that allows a natural, easy reciprocating vertical movement. For children, holding this brush with such a different handle becomes a game, resulting in better hygiene. Studies have shown that handicapped persons have greater facility in producing an up-and-down movement than horizontal pushes and pulls.

Several toothbrush models having the form of a capital T allow an up-and-down brushing of the teeth; the brush body is the top horizontal member and the handle is the vertical staff of the T.

Some models are fixed, such as those described in documents DE 3228946 and FR 2,583,963. The first document describes a straight brush body or curved in order to accommodate the concavity of the jaw. Document FR 2,583,963 shows a brush whose orientation is accomplished by deformation of the handle which must be manufactured from a material with appropriate mechanical properties, or from a flexible plastic material molded onto a metal insert. These two documents do not reflect that about one-third of the handle, starting from the brush body, must have a concave curve with respect to the face when the brush is in the cleaning position. The information from these documents only poses the problem of what the geometric invention should be without defining the materials and their geometric shape, the precise definition of which is not evident to a specialist. The solution to the problems of such type of brush is not indicated in order that the technical questions might be resolved.

In document WO 95/01113 the angular hold is obtained by a mushroom shaped pin with longitudinal thin strips that engage in a cavity of the handle. In documents DE 2427877 and FR 2,583,963 the blocking of rotation is effected only in two positions, one longitudinal and the other transversal. These three documents do not take into account the curvature of the handle in order to make transversal brushing possible without striking the chin. The numerous unsealed surfaces of the rotation systems are only so many niches for detritus and bacteria that are reintroduced into the mouth at the next brushing. Toothpaste can penetrate between these surfaces, and hardening there, can jam the system and considerably increase the wear of the friction parts, and thus the working life of the unit. Document FR 2,583,963 FIGS. 1, 5, 7, and document DT 24,27,877 FIGS. 3, 4, 5 show a handle the concave part of which corresponds only to the length of clearance of rotation of the brush body, which is clearly insufficient to clear the chin. The profile of the handle of document UK 2101476 is totally nonfunctional because the starting point of the handle comes up against the lips, hindering the brushing.

Document D 077,889 shows a brush with two transversal positions and two longitudinal positions where the male end of the handle dovetails into the brush body. Blocking-in-position is obtained by a system of balls and a spring placed in the brush body. This document does not take into account the necessary curve of the handle to allow it to clear the chin. This system also has the disadvantage that the blocking-in-position is not definitive and the brush body can separate from the handle in the mouth and can be swallowed or cause a more serious accident by obstruction of the upper respiratory tract.

The handles shown in this prior art only take into account the rotation of the brush body while completely ignoring the problem posed by the clearance of the chin.

In other models, the brush body is shown rotatable on the handle, in order to bring it back in line with the handle in a traditional front-to-back brushing of the teeth. U.S. Pat. No. 5,499,422 describes a brush the handle of which is blocked in position with respect to the brush body by an anti-friction washer pressed by a rivet between a surface of the handle and a surface of the brush body. Document GB 2,101,476 shows a system for blocking-in-position that is composed of sufficient friction or by an appropriate locking means, whether the handle is constituted by a groove and a spring joint or equivalent means, or the shaft is equipped with a spring to make the head interchangeable. In these documents the means for blocking-in-position are not precisely described. It is also said that the head is interchangeable, which involves the risk that the brush body would detach and be swallowed during use, and possibly the risk of a more serious accident through obstruction of the respiratory tract. The large surface area between the two opposite supports and the unprotected mechanism constitute a niche for detritus and bacteria that are not compatible with our standards of hygiene. In U.S. Pat. No. 4,020,521, the rotation of the brush body is blocked by recessed saw tooth grooves according to the generators of a cylindrical bar of the brush body cooperating with the complementary recessed grooves around the periphery of an aperture in the handle. To allow the inclusion of the larger diameter bar in the bore hole, the hole has a radial slot on the outside. In this patent, the mechanism has no means, during the use of the brush, to prevent the separation of the brush body and handle, thus producing a significant risk of swallowing the brush body as well as the risk of obstruction of the respiratory tract as well. The mechanism has no protection to isolate the detritus, bacteria and toothpaste. Moreover, in FIG. 1 of the patent, it can be seen that the end of the split handle when it is in the transversal position projects outside the brush body and butts against the top of the gingivae, making it impossible to use the brush in the transversal position.

According to the invention, the elasticity and mechanical strength designs of the brush have made it possible to select type DR 51 PBT food Nylon as material. The brush body is fixedly connected, on one of its large sides, to the curved handle the direction of which is approximately in a center plane of the brush body. The brush body should be long enough that its right and left ends reach the molars without the starting point of the curved handle uncomfortably deforming the corner of the mouth, and that the handle can, by a narrowing, take the longitudinal position and the transversal position.

According to another example of realization, the handle is movably mounted on the brush body. It pivots around an assembly and blocking means between the handle and the brush body fix the handle in the transversal and longitudinal positions.

BRIEF SUMMARY OF THE INVENTION

The invention concerns a transversal toothbrush composed of a brush body and a handle the longitudinal direction of which is transversal in an angled or perpendicular manner, with respect to the longitudinal direction of the brush body, so as to permit a transversal up-and-down brushing parallel to the direction of the teeth; in such a way, that the handle, after the brush body, has a curve so that during brushing the bristles of the brush make good contact with the teeth and the handle clears the lips and chin. The part of the handle connected to the brush body is at an angle between 2° and 45° with the plane of the brush. Starting from the end in contact with the brush body, the profile of the handle has a concave curved region 6.7 centimeters long with a maximum depth of 1 centimeter tending to move the handle laterally away from the plane of the brush, then an inflexion region where the curve is reversed, making an angle of 0.5° to 10° with respect to the plane of the brush, then a convex handgrip region.

The free end of the handle broadens out in the form of a tripod, allowing the brush to be supported vertically, directly on a horizontal plane. The brush handle has a deformation region allowing the handle to take all transversal or longitudinal positions. The deformation region is of the same material as the brush, i.e., a plastic material having physical properties identical to what is marketed under the type DR 51 PBT food Nylon brand and rectangular in shape 1.5 millimeters wide, 10 millimeters long and 4.5 millimeters high. The brush is rotatably mounted with blocking-in-position accomplished on the brush body by a truncated cone with recessed or raised teeth topped by a shaft with a retention lip, and attached to the handle by a hood apertured to the diameter of the shaft, and at least two teeth and a cylinder part cooperating with the teeth of the brush body; or, by a smooth truncated cone and topped with a shaft and attached to the handle by an apertured conical hood; or, by a truncated cone with recessed and raised teeth topped with a shaft with a retention lip and attached to the handle by a hood apertured to the diameter of the shaft, and at least three cylinder parts cooperating with the teeth of the brush body. The upper sealing means between the support shaft and the aperture of the hood are provided by the same diameter aperture and shaft. The lower sealing means are provided by the base of the hood which penetrates the brush body by the recessed groove.

The invention is better understood by viewing the examples of realization shown in the attached drawings.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention.

Figure 1A:
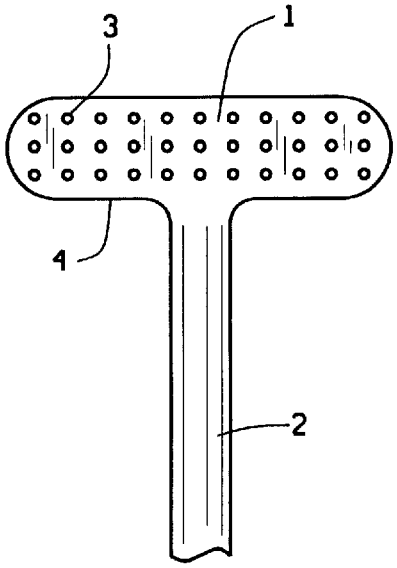
FIG. 1*a* shows a fixed transversal handle toothbrush.
Figure 1B:
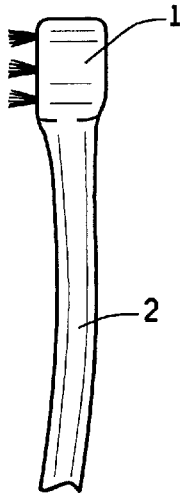
FIG. 1*b* shows a side view of a fixed transversal handle toothbrush.
Figure 1C:
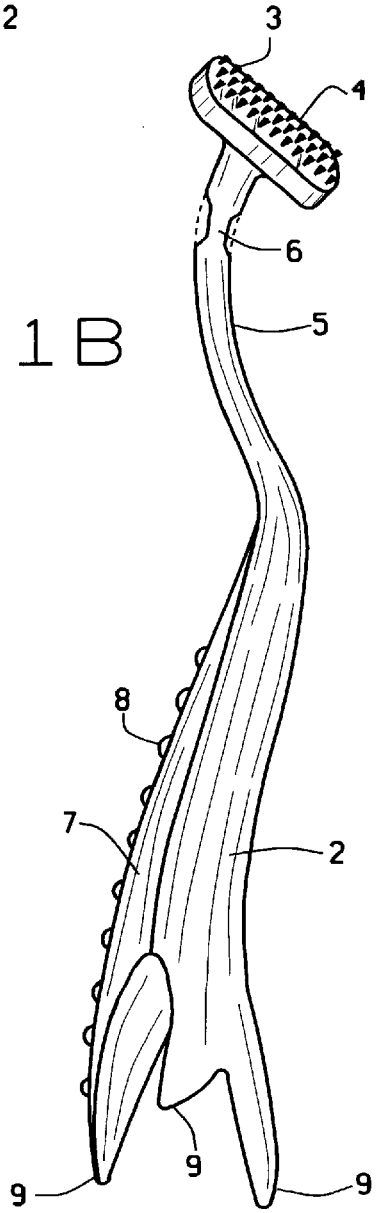
FIG. 1*c* shows a toothbrush with the deformation region.

The brush according to the invention is composed of an elongated brush body (1), rectangular in shape, preferably having one to four longitudinal rows of holes (3) in the brush body to hold the bristles, and an elongated handle (2) perpendicular to the longitudinal direction of the brush body. The handle (2) is connected directly to the brush body (1) on one large side (4) of the latter; or, on the rear face of the brush body in such a way that the plane of the front face of the brush body (1) is in a plane offset with respect to the plane containing the handle which has immediately after its point of origin a curve (5) which allows clearance of the jaw while the brush is being used. Each of the two wings of the brush body on each side of the handle (2) is of sufficient length that the tufts of the end bristles reach the teeth at the back when the point of origin of the handle is in contact with the corner of the mouth. The handle has been designed so that in cross section, after its point of origin, it has an ovoid shape with diameters of 5.5 millimeters by 5 millimeters, and has a regular curve or contour (5) with a height of 6.7 centimeters and a maximum depth of 10 millimeters with respect to a line connecting the two ends of this curve. According to studies, in 95% of cases this allows the chin to be cleared when the brush is used in the most comfortable position; i.e., the elbow pressed against the body, and the forearm, wrist and hand in the same plane very close to the chest in order to reduce as much as possible the effort due to brushing. Because this brushing position is the most natural, it allows the bristles of the brush to be uniformly in contact with the teeth and gingivae for maximum effectiveness. On the curve, at 15 millimeters from the brush body, there is a narrowing (6) or deformation region that allows the brush to be moved laterally without changing the position of the brush body. This narrowing is centered in the longitudinal axis of the handle. It has a thickness of 1.5 millimeters, a length of 10 millimeters, and a height of 4.5 millimeters. It allows the lateral movement of the handle with respect to the brush body. For aesthetic reasons, it is covered with an elastic over-molding. After the first curve, the handle has a reverse curve of 2° (two degrees) which increases in volume because this is the area that is held by the hand. Its thickness goes from 14 millimeters to 27 millimeters. The interior of the handle, in this larger part, is hollow for economy of weight and raw material. The grip has an over-mold of elastic material (7) and has 10 semicircles (8) for a better grip of the brush. It ends in a tripod the points (9) which are spaced 20 millimeters apart and which allows the brush to stand upright without support for better hygiene (FIG. 1*c*).

The power brush is attached to the handle after the curved part required to clear the chin. The other brush examples are provided for the same handle as the one described above.

According to another example of realization, the handle (2) is movably mounted on the body of the brush (1) in such a way that the longitudinal axes of the handle and brush body can take different directions. This mobility allows several advantageous configurations of the brush. The first consists of transforming the transversal brush according to the invention into a longitudinal brush where the axes of the handle and brush body are aligned, the handle being able to take any intermediate directions with respect to the brush body which allow the means of attachment and mechanical blocking of the handle to the brush body. Thus the brush body, in its transversal center plane, has a gear-shaped truncated cone (10) with a 70° sweep angle with 12 rounded teeth in relief (11) with a value of 0.5 and 12 recessed rounded teeth (12) with a value of 0.5. The rounded shape of the teeth was designed to limit the wear of the mechanism and to facilitate the orientation of the handle by elastic deformation of the cooperating parts. The teeth are equidistant from each other. The angle between one tooth in relief and the next recessed tooth is 15°. On the upper base of the truncated cone is centered a shaft (13) the top of which has a radius of 1.85 millimeters and a height of 1 millimeter, and the bottom has a radius of 1.55 millimeter and a height of 1 millimeter. This top part of the shaft is called the retention lip (14). This cone and shaft assembly is of the same material as the brush body and they are molded together at the same time. The handle is elongated at its end by a hood (15) the circular base of which has a diameter of 11.6 millimeters, the top a diameter of 5 millimeters, with a height of 4.6 millimeters. The top has an aperture (16) with a radius of 1.55 millimeters in order to clip it onto the shaft, so that the assembly cannot be taken apart.

According to a first variation, inside the hood (FIG. 3*b*) and at its top, in front of the end of the handle, there are two rounded 0.5 teeth (17) for blocking the handle, hood and brush body assembly in position. Inside of the hood, throughout its fall height there is a conical part of a cylinder (18) opposite the teeth in relief of the brush body, for the purpose of centering and blocking the handle in position. The change from one tooth to the other is possible because of the elasticity of the cooperating parts and the slight raising (0.5 millimeter) of the hood when changing from one tooth to the other tooth. The seal for the upper part of the hood is ensured by the diameter of the shaft being identical to that of the aperture of the hood. The lower seal is ensured by a recessed circular guide track (19) in the brush body, and by the base of the hood (20) which is accommodated therein.

Figure 3A:
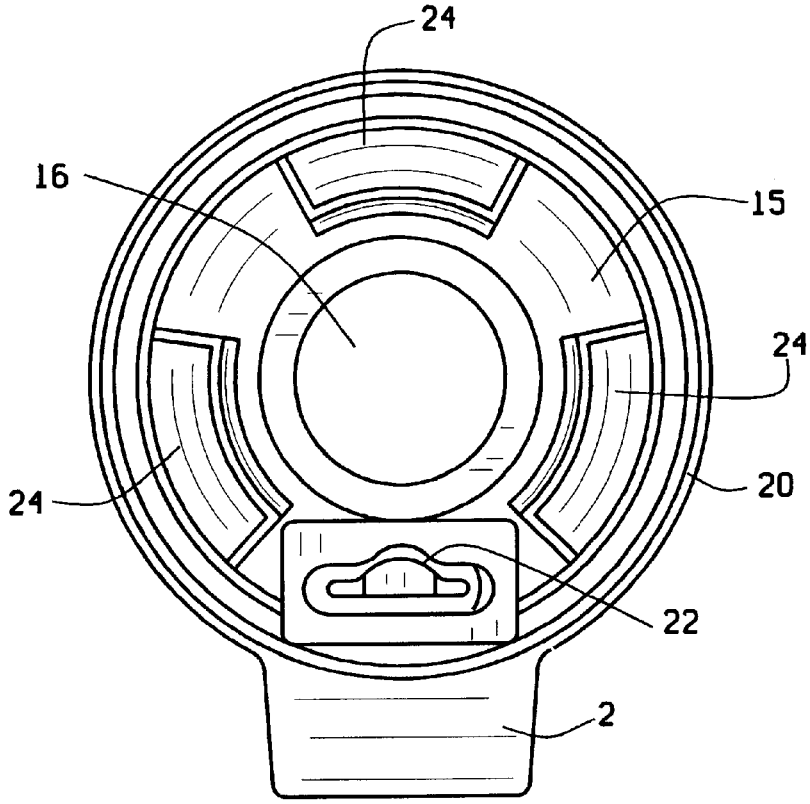
FIG. 3*a* shows the hood with the three cylinder parts for blocking in position and the pawl.
Figure 3B:
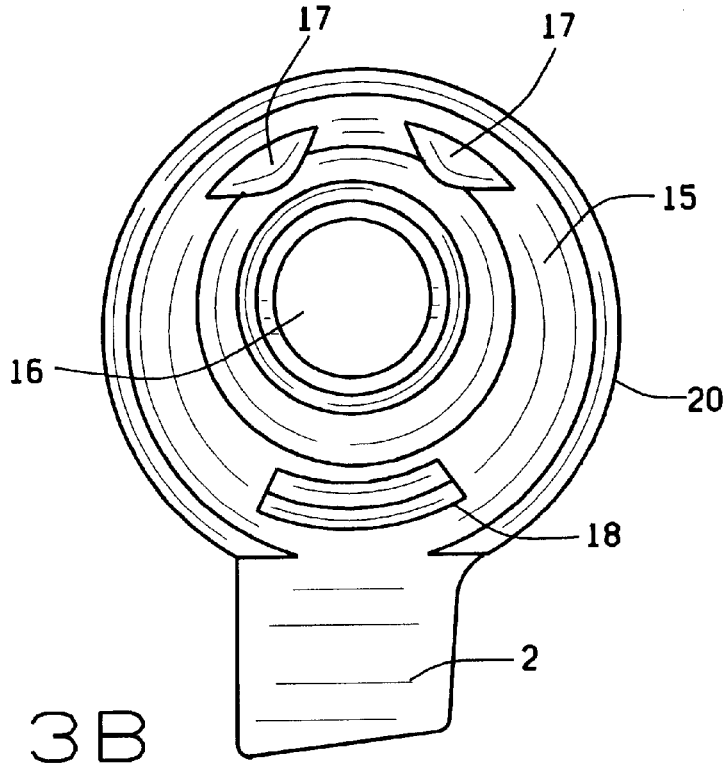
FIG. 3*b* shows the hood with two teeth for blocking in position and a cylinder part for centering and holding.
Figure 4A:
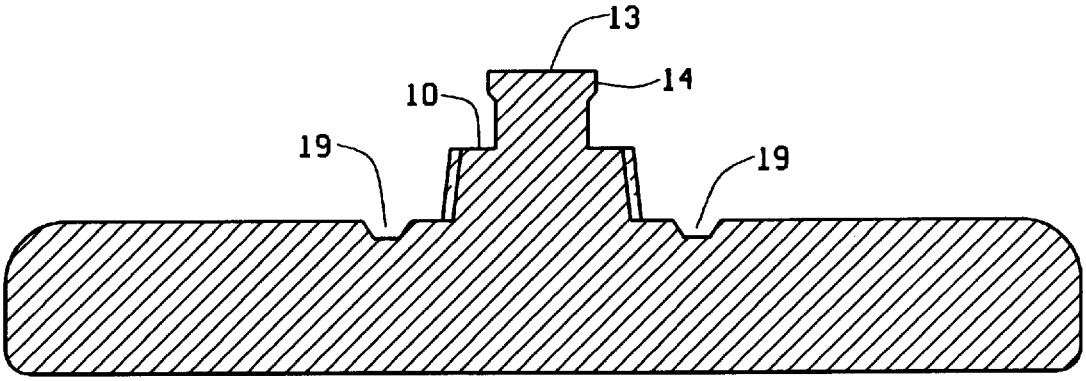
FIG. 4*a* shows a longitudinal cross section of the brush body.
Figure 4B:
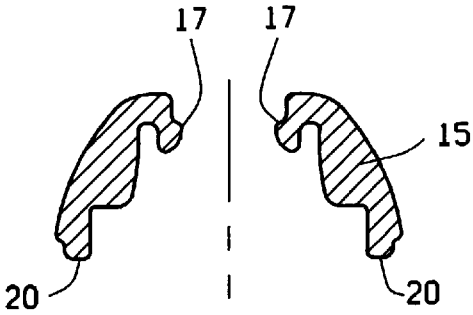
FIG. 4*b* shows a longitudinal cross section of the hood with the two teeth.

According to a second variation, FIG. 3*a* there are three cylinder parts (21) equidistant from each other to come into contact with the teeth in relief, thus ensuring the centering of the assembly. The blocking-in-position is made possible by a pawl (22) acting as a tooth and cooperating with the teeth of the cone of the brush body. The change of position of the handle is possible because of the elasticity of cooperating parts and by the slight raising (0.5 millimeter) of the hood.

Figure 2A:
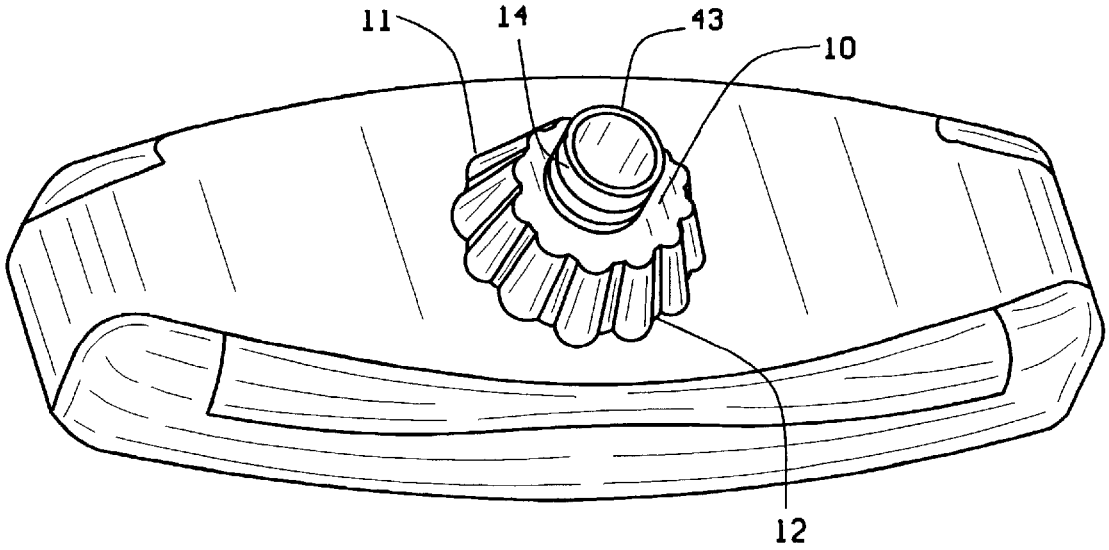
FIG. 2*a* shows a brush body with a geared truncated cone.
Figure 2B:
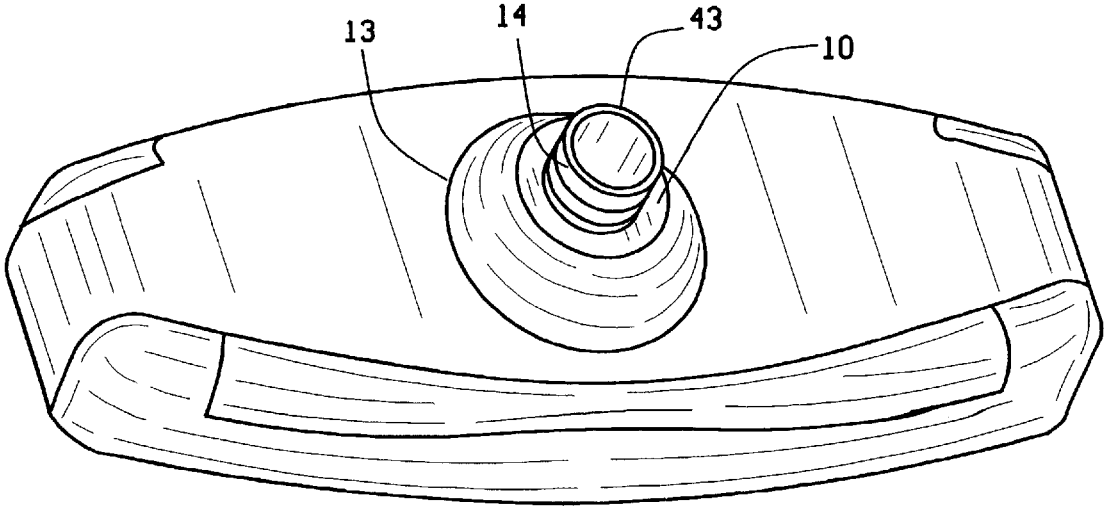
FIG. 2*b* shows a brush body with smooth cone.

According to another example of realization, approximately on the transversal central plane of the brush body (FIG. 2*b*), there is a truncated cone with smooth surface (23) topped by the same type of shaft as described where the cone is toothed, and in which the handle has, opposite its end, a circular hood the internal surface of which exactly fits on the outer surface of the cone of the brush body. Because the top of the hood is apertured as in the examples described above, the blocking in position is achieved by friction of one cone inside the other.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

What is claimed is:

1. A transversal toothbrush composed of an elongated brush body (1), and an elongated handle (2) the longitudinal direction of which is transversal with respect to the longitudinal direction of the brush body so as to permit a transversal up-and-down brushing parallel to the direction of the teeth, in such a way that the handle, after the brush body, has a curve (5) so that during brushing, the bristles of the brush make good contact with the teeth and the handle clears the lips and chin, and the profile of the handle has a concave region (5) starting from the end in contact with the brush body tending to move the handle laterally away from the plane of the brush body, the profile of the handle then has an inflexion region where the curve is reversed and the handle is rotatably mounted with a blocking-in-position accomplished on the brush body (1) by a truncated cone (10) with respective recessed (12) and raised (11) teeth, the body topped by a shaft (13) with a retention lip (14) and attached to the handle by a hood (15) apertured (16) to the diameter of the shaft and at least two teeth (17) and a cylinder part (18) cooperating with the teeth of the brush body.

2. The toothbrush according to claim 1, in which the part of the handle connected to the brush body is generally transversal in an angled manner with respect to the longitudinal direction of the brush body.

3. The toothbrush according to claim 2, in which the part of the handle connected to the brush body is at an angle generally between 2° and 45° with the plane of the brush body.

4. The toothbrush according to claim 1, in which the part of the handle connected to the brush body is transversal in a perpendicular manner with respect to the longitudinal direction of the brush body.

5. The toothbrush according to claim 1, in which the inflexion region where the curve is reversed makes an angle of generally 0.5° to 10° with respect to the plane of the brush body, and then makes a convex handgrip region.

6. The toothbrush according to claim 1, in which the free end of the handle broadens out in the form of a tripod (9) such that the brush is supported vertically, directly on a horizontal plane.

7. The toothbrush according to claim 1 in which the brush handle has a deformation region (6) allowing the handle to take all transversal or longitudinal positions with respect to the plane of the brush body.

8. The toothbrush according to claim 7 in which the deformation region is of the same material as the body and the handle.

9. The toothbrush according to claim 7 in which the deformation region is generally rectangular in shape.

10. The toothbrush according to claim 9 in which the body and the handle and deformation region are made of a type DR 51 PBT food nylon.

11. The toothbrush of claim 10 in which the deformation region is approximately 1.5 millimeters wide, approximately 10 millimeters long, and approximately 4.5 millimeters high.

12. The toothbrush according to claim 1 in which the concave curved region (5) is approximately 6.7 centimeters long with a maximum depth of approximately 1 centimeter.

13. The toothbrush of claim 1 having a seal provided by the aperture (16) of the hood and the shaft (13), and a sealing lip (20) of the hood which penetrates a cavorelievo (19) of the brush body.

14. A transversal toothbrush composed of an elongated brush body (1), and an elongated handle (2) the longitudinal direction of which is transversal with respect to the longitudinal direction of the brush body so as to permit a transversal up-and-down brushing parallel to the direction of the teeth, the handle, after the brush body, has a curve (5) so that during brushing, the bristles of the brush make good contact with the teeth and the handle clears the lips and chin and starting from the end in contact with the brush body, the profile of the handle has a concave region (5) tending to move the handle laterally away from the plane of the brush body, then an inflexion region where the curve is reversed and the handle is rotatably mounted with a blocking-in-position accomplished on the brush body by a smooth truncated cone (23) and topped with a shaft (13), and attached to the handle by an apertured conical hood.

15. The toothbrush according to claim 14, in which the part of the handle connected to the brush body is generally transversal in an angled manner with respect to the longitudinal direction of the brush body.

16. The toothbrush according to claim 15, in which the part of the handle connected to the brush body is at an angle generally between 2° and 45° with the plane of the brush body.

17. The toothbrush according to claim 14, in which the part of the handle connected to the brush body is transversal in a perpendicular manner with respect to the longitudinal direction of the brush body.

18. The toothbrush according to claim 14, in which the inflexion region where the curve is reversed makes an angle of 0.5° to 10° with respect to the plane of the brush body, and then makes a convex handgrip region.

19. The toothbrush according to claim 14 in which the free end of the handle broadens out in the form of a tripod (9), allowing the brush to be supported generally vertically, directly on a generally horizontal plane.

20. The toothbrush according to claim 14 in which the brush handle has a deformation region (6) allowing the handle to take all transversal or longitudinal positions with respect to the plane of the brush body.

21. The toothbrush according to claim 20 in which the deformation region is of the same material as the body and the handle.

22. The toothbrush according to claim 20 in which the deformation region is generally rectangular in shape.

23. The toothbrush according to claim 22 in which the body and the handle and deformation region are made of a type DR 51 PBT food nylon.

24. The toothbrush of claim 23 in which the deformation region is approximately 1.5 millimeters wide, 10 millimeters long, and 4.5 millimeters high.

25. The toothbrush according to claim 14 in which the concave curved region (5) is approximately 6.7 centimeters long with a maximum depth of approximately 1 centimeter.

26. The toothbrush of claim 14 having a seal provided by the aperture (16) of the hood and the shaft (13), and a sealing lip (20) of the hood which penetrates a cavorelievo (19) of the brush body.

27. A transversal toothbrush composed of an elongated brush body (1), and an elongated handle (2) the longitudinal direction of which is generally transversal with respect to the longitudinal direction of the brush body so as to permit a transversal up-and-down brushing parallel to the direction of the teeth such that the handle, after the brush body, has a curve (5) so that during brushing, the bristles of the brush make good contact with the teeth and the handle clears the lips and chin and starting from the end in contact with the brush body, the profile of the handle has a concave region (5) tending to move the handle laterally away from the plane of the brush body, then an inflexion region where the curve is reversed and the handle is rotatably mounted with a blocking-in-position accomplished on the brush body (1) by a truncated cone (10) with respective recessed (12) and raised (11) teeth, the body topped by a shaft (13) with a retention lip (14) and attached to the handle by a hood (15) apertured (16) to the diameter of the shaft, and at least three cylinder parts (21) cooperating with the teeth of the brush body.

28. The toothbrush according to claim 27, in which the part of the handle connected to the brush body is generally transversal in an angled manner with respect to the longitudinal direction of the brush body.

29. The toothbrush according to claim 28, in which the part of the handle connected to the brush body is at an angle generally between 2° and 45° with the plane of the brush body.

30. The toothbrush according to claim 27, in which the part of the handle connected to the brush body is generally transversal in a perpendicular manner with respect to the longitudinal direction of the brush body.

31. The toothbrush according to claim 27, in which the inflexion region where the curve is reversed makes an angle generally of 0.5° to 10° with respect to the plane of the brush body and then makes a convex handgrip region.

32. The toothbrush according to claim 27, in which the free end of the handle broadens out in the form of a tripod (9), allowing the brush to be supported generally vertically, directly on a generally horizontal plane.

33. The toothbrush according to claim 27, in which the brush handle has a deformation region (6) allowing the handle to take all transversal or longitudinal positions with respect to the plane of the brush body.

34. The toothbrush according to claim 33, in which the deformation region is of the same material as the body and the handle.

35. The toothbrush according to claim 33, in which the deformation region is generally rectangular in shape.

36. The toothbrush according to claim 35, in which the body and the handle and deformation region are made of a type DR 51 PBT food nylon.

37. The toothbrush of claim 36, in which the deformation region is approximately 1.5 millimeters wide, 10 millimeters long, and 4.5 millimeters high.

38. The toothbrush according to claim 27, in which the concave curved region (5) is approximately 6.7 centimeters long with a maximum depth of approximately 1 centimeter.

39. The toothbrush of claim 27, having a seal provided by the aperture (16) of the hood and the shaft (13), and a sealing lip (20) of the hood which penetrates a cavorelievo (19) of the brush body.

* * * * *